US006913521B2

(12) United States Patent
Owczarz et al.

(10) Patent No.: US 6,913,521 B2
(45) Date of Patent: Jul. 5, 2005

(54) METHODS USING ACTIVE RETAINER RINGS FOR IMPROVING EDGE PERFORMANCE IN CMP APPLICATIONS

(75) Inventors: Alek Owczarz, San Jose, CA (US); John Boyd, Atascadero, CA (US); Rod Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/874,415

(22) Filed: Jun. 22, 2004

(65) Prior Publication Data

US 2004/0235399 A1 Nov. 25, 2004

Related U.S. Application Data

(62) Division of application No. 09/747,828, filed on Dec. 21, 2000, now Pat. No. 6,776,695.

(51) Int. Cl.[7] ..... B24B 1/00

(52) U.S. Cl. ..... 451/41; 451/398; 451/397; 451/296; 451/300; 451/303; 451/306; 451/299

(58) Field of Search ..... 451/397, 398, 451/303, 300, 306, 299, 296, 307, 285, 286, 41, 57

(56) References Cited

U.S. PATENT DOCUMENTS

| | | | | |
|---|---|---|---|---|
| 4,606,151 A | | 8/1986 | Heynacher | |
| 4,850,152 A | | 7/1989 | Heynacher et al. | |
| 5,575,707 A | | 11/1996 | Talieh et al. | |
| 5,584,751 A | | 12/1996 | Kobayashi et al. | |
| 5,662,518 A | | 9/1997 | James et al. | |
| 5,695,392 A | | 12/1997 | Kim | |
| 5,722,877 A | | 3/1998 | Meyer et al. | |
| 5,762,546 A | | 6/1998 | James et al. | |
| 5,800,248 A | | 9/1998 | Pant et al. | |
| 5,888,120 A | | 3/1999 | Doran | |
| 5,888,126 A | | 3/1999 | Hirose et al. | |
| 5,916,012 A | | 6/1999 | Pant et al. | |
| 5,931,719 A | | 8/1999 | Nagahara et al. | |
| 5,961,372 A | | 10/1999 | Shendon | |
| 5,980,368 A | | 11/1999 | Chang et al. | |
| 5,989,104 A | | 11/1999 | Kim et al. | |
| 6,024,630 A | * | 2/2000 | Shendon et al. | 451/41 |
| 6,045,431 A | | 4/2000 | Cheprasov et al. | |
| 6,062,959 A | | 5/2000 | Weldon et al. | |
| 6,102,786 A | | 8/2000 | Hirose et al. | |
| 6,103,628 A | | 8/2000 | Talieh | |
| 6,126,527 A | | 10/2000 | Kao et al. | |
| 6,135,858 A | | 10/2000 | Takahashi | |
| 6,135,859 A | | 10/2000 | Tietz | |
| 6,183,350 B1 | * | 2/2001 | Lin et al. | 451/41 |
| 6,234,878 B1 | | 5/2001 | Moore | |
| 6,435,949 B1 | * | 8/2002 | Katsuoka et al. | 451/59 |
| 6,491,570 B1 | * | 12/2002 | Sommer et al. | 451/41 |
| 6,776,695 B2 | * | 8/2004 | Owczarz et al. | 451/44 |

FOREIGN PATENT DOCUMENTS

| | | |
|---|---|---|
| EP | 0881039 | 12/1998 |
| EP | 0920956 | 6/1999 |
| FR | 2767735 | 8/1998 |
| JP | 03259520 | 11/1991 |

* cited by examiner

*Primary Examiner*—George Nguyen
(74) *Attorney, Agent, or Firm*—Martine Penilla & Gencarella LLP

(57) ABSTRACT

An invention improves edge performance in chemical mechanical polishing processes. A method operation provides a wafer head above a wafer. The wafer head includes a first active retaining ring capable of extension and retraction. Another operation provides a polishing belt below the wafer head, and provides below the polishing belt a platen having a second active retaining ring capable of extension and retraction. Another operation controls positions of the first active retaining ring and the second active retaining ring to provide positional control for the polishing belt, thus adjusting and controlling the removal rate at the edge of the wafer.

18 Claims, 8 Drawing Sheets

METHODS USING ACTIVE RETAINER RINGS FOR IMPROVING EDGE PERFORMANCE IN CMP APPLICATIONS

CROSS REFERENCE TO RELATED APPLICATIONS

The present application is a divisional of U.S. patent application Ser. No. 09/747,828, filed Dec. 21, 2000 U.S. Pat. No. 6,776,695 (the "Parent Application"), priority under 35 U.S.C. 120 is hereby claimed based on the Parent Application, and such Parent Application is hereby incorporated herein by reference. This application is related to the following applications: (1) U.S. patent application Ser. No. 09/747,845, filed Dec. 21, 2000, and entitled "Pressurized Membrane Platen Design for Improving Performance in CMP Applications"; and (2) U.S. patent application Ser. No. 09/747,844, filed Dec. 21, 2000, and entitled "Piezoelectric Platen Design for Improving Performance in CMP Applications" (collectively, the "Related Applications"). Each of these Related Applications is hereby incorporated herein by reference.

BACKGROUND OF THE INVENTION

1. Field of the Invention

This invention relates generally to chemical mechanical polishing apparatus, and more particularly to methods for improved edge performance in chemical mechanical polishing applications via a platen-mounted active retaining ring.

2. Description of the Related Art

In the fabrication of semiconductor devices, there is a need to perform Chemical Mechanical Polishing (CMP) operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization. Further applications include planarization of dielectric films deposited prior to the metallization process, such as dielectrics used for shallow trench isolation or for poly-metal insulation.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 10. The CMP system 10 in FIG. 1 is a belt-type system, so designated because the preparation surface is an endless belt 18 mounted on two drums 24 which drive the belt 18 in a rotational motion as indicated by belt rotation directional arrows 26. A wafer 12 is mounted on a wafer head 14, which is rotated in direction 16. The rotating wafer 12 is then applied against the rotating belt 18 with a force F to accomplish a CMP process. Some CMP processes require significant force F to be applied. A platen 22 is provided to stabilize the belt 18 and to provide a solid surface onto which to apply the wafer 12. Slurry 28 composing of an aqueous solution such as $NH_4OH$ or DI containing dispersed abrasive particles is introduced upstream of the wafer 12. The process of scrubbing, buffing and polishing of the surface of the wafer is achieved by using an endless polishing pad glued to belt 18. Typically, the polishing pad is composed of porous or fibrous materials and lacks fixed abrasives.

FIG. 2 is a detailed view of a conventional wafer head and platen configuration 30. The wafer head and platen configuration 30 includes the wafer head 14 and the platen 22 positioned below the wafer head 14. The wafer head 14 includes a fixed retaining ring 32 that holds the wafer 12 in position below the wafer head 14. Between the wafer head 14 and the platen 22 is the polishing pad and belt 18. Often, the platen includes air holes to provide upward air pressure to the polishing pad and belt 18, thus providing a cushion of air upon which to apply the wafer 12.

The CMP process is often used to remove excess film overburden, such as a layer of copper or oxide dielectric. However, the prior art wafer head and platen configuration 30 typically causes a high removal rate along the edges of the wafer 12, and a more moderate removal rate in the interior of the wafer 12, as illustrated in FIGS. 3A and 3B.

FIG. 3A is an illustration showing positional information on the wafer 12. The wafer 12 includes positional designations 40, wherein the center of the wafer is marked as the origin (position 0), the left most edge as position −100 and the right most edge as position 100. Measuring the removal rate of the polished layer on the wafer 12 at each position 40 during a conventional CMP process results in the graph of FIG. 3B.

FIG. 3B is a graph 50 showing the CMP removal rate as a function of wafer position during a conventional CMP operation. As shown by the graph 50, the removal rate at the edge of the wafer is extremely high relative to the removal rate at other positions 40 along the wafer surface. This is a result of the retaining ring 32 interfering with the polishing of the exposed wafer surface, the surface and thickness characteristics of the retaining ring 32 adversely affect the wafer polishing. As a result of the high removal rate at the edge of the wafer surface, the wafer edges may become rounded, which adversely affects the quality of the wafer 12.

In view of the foregoing, there is a need for an improved CMP process that more closely maintains an even removal rate throughout the CMP process. The method should allow for fine tuning of wafer edge removal rates so as to provide an evenly polished wafer surface.

SUMMARY OF THE INVENTION

Broadly speaking, the present invention fills these needs by providing an improved edge performance method for a CMP process using a platen having an active retaining ring. In one embodiment, a method for improving edge performance in chemical mechanical polishing applications is disclosed. Initially, a wafer head is provided having a first active retaining ring. In addition, a platen having a second active retaining ring is provided. The first active retaining ring is extended and the second active retaining ring is retracted. Then, the second active retaining ring is extended and the first active retaining ring is retracted. In this manner, positional control of the polishing belt is maintained throughout the CMP process allowing improved edge performance.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for improved edge performance in a CMP process using an active retaining ring on a platen. The embodiments of the present invention provide an active retaining ring on both the wafer head and the platen. The active retaining rings provide precise positional control of the polishing pad relative to the wafer edge, allowing engineering of the pad shape and interaction angle with the wafer edge. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to obscure the present invention.

Figure 1:
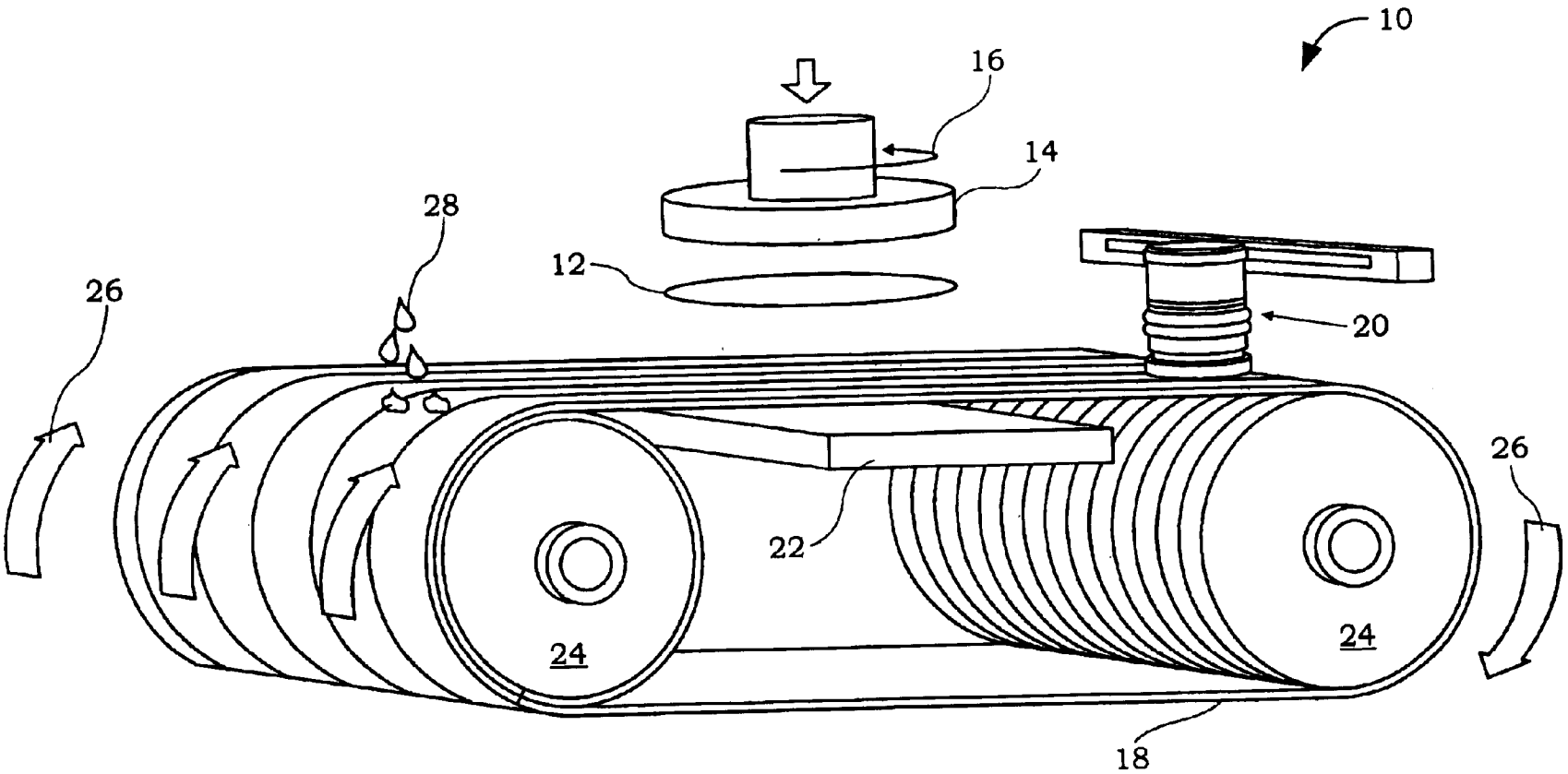
FIG. 1 (Prior Art)
FIG. 1 illustrates an exemplary prior art CMP system.
Figure 2:
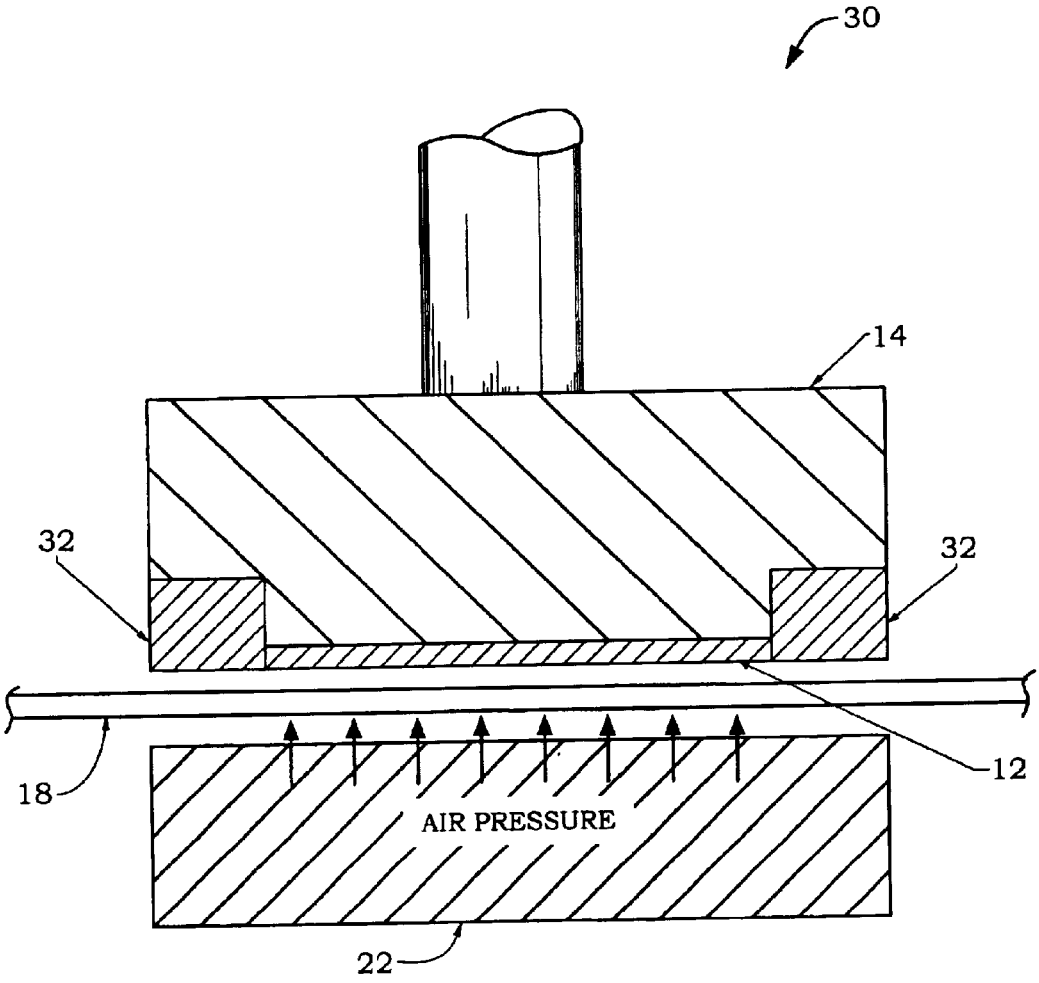
FIG. 2 (Prior Art)
FIG. 2 is a detailed view of a conventional wafer head and platen configuration.
Figure 3A:
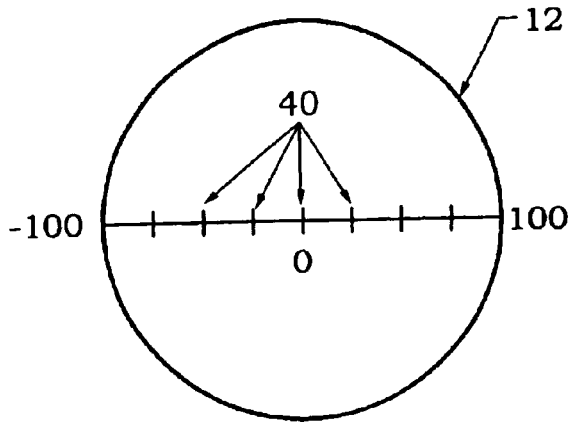
FIG. 3A (Prior Art)
FIG. 3A is an illustration showing positional information on the wafer.
Figure 3B:
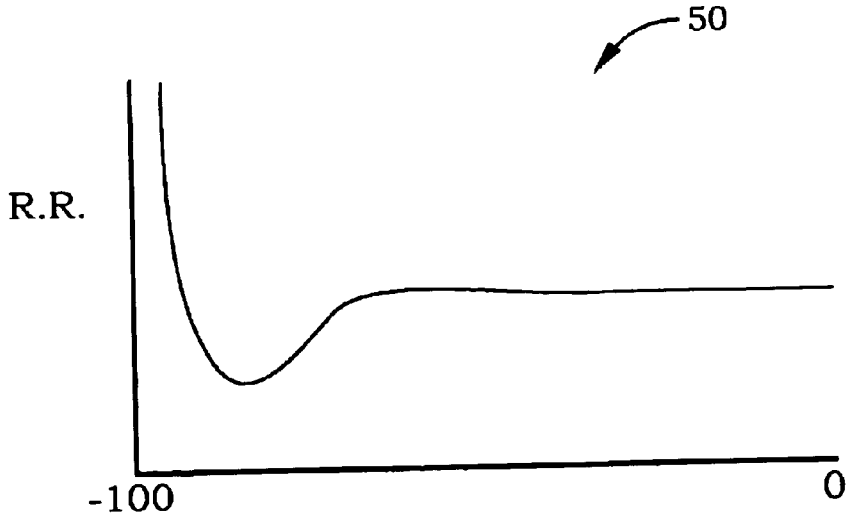
FIG. 3B (Prior Art)
FIG. 3B is a graph showing the CMP removal rate as a function of measurement position on a wafer diameter during a conventional CMP operation.
Figure 4A:
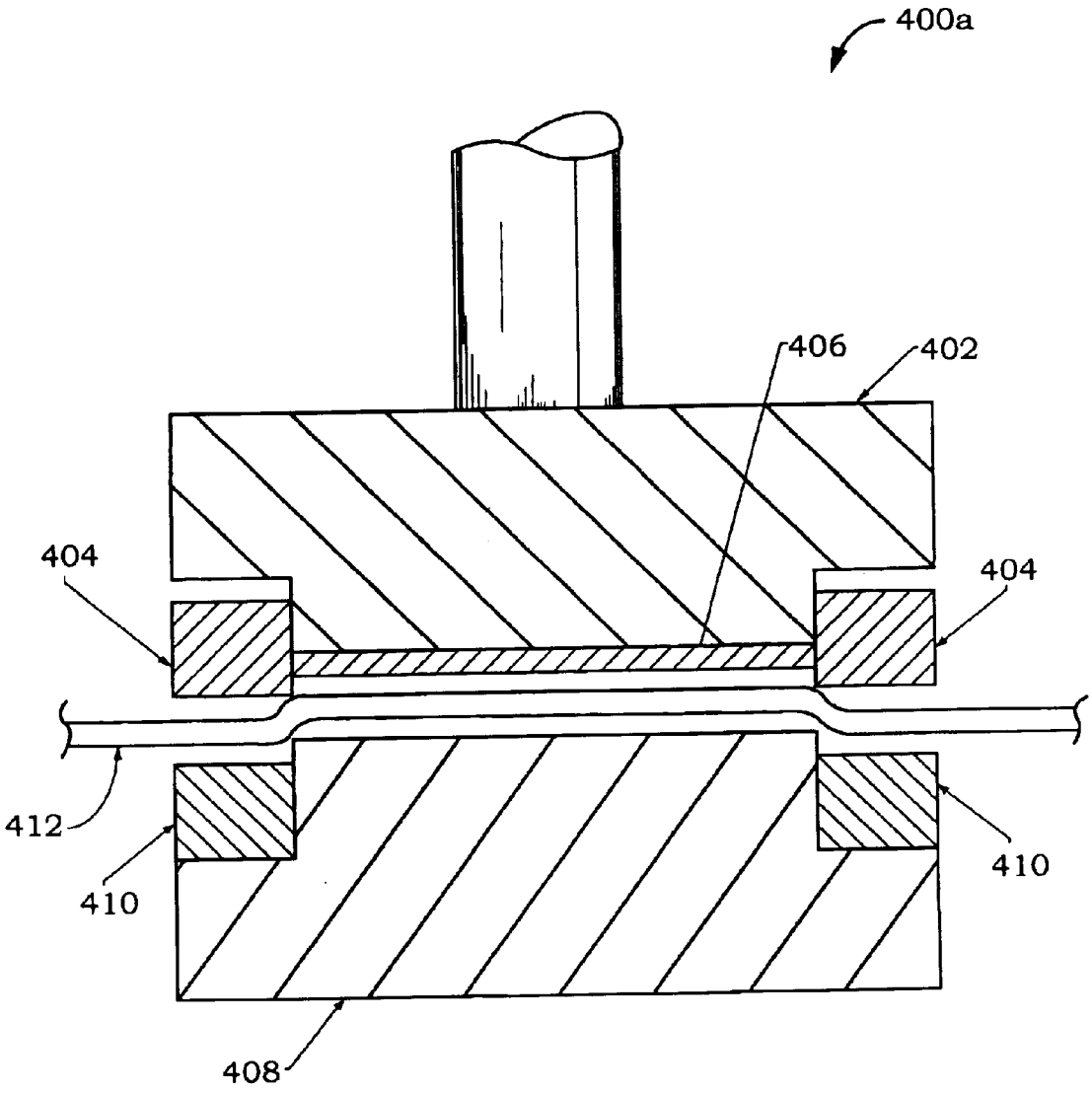
FIG. 4A is a retaining ring configuration for decreasing the removal rate at the edge of a wafer, in accordance with an embodiment of the present invention.

FIGS. 1–3 have been described in terms of the prior art. FIG. 4A is a retaining ring configuration 400*a* for decreasing the removal rate at the edge of a wafer, in accordance with an embodiment of the present invention. The retaining ring configuration 400*a* includes a wafer head 402 having an active retaining ring, or active retainer ring, 404 and a wafer 406 positioned below the wafer head 402. The active retaining ring 404 is capable of extending and retracting from the wafer head 402 to provide increased positional control of the polishing belt 412 relative to the wafer edge. Further shown in FIG. 4A, is a platen 408 disposed below the polishing belt 412. The platen 408 includes an active retaining ring, or active retainer ring, 410 also capable of extending and retracting to provide increased positional control of the polishing belt 412.

The platen 408 often is closely spaced from the polishing pad or belt 412 that polishes the surface of the wafer 406, with a very thin air space, referred to as an "air bearing", being defined between the platen 408 and the polishing pad 412. It is advantageous to maintain an air bearing between the platen and the pad to promote more uniform polishing of the surface as well as reduce friction from the belt/platen interaction. Specifically, the polishing uniformity can be controlled using an air bearing.

To maintain the air bearing, air source holes can be formed in the platen 408 and arranged in concentric ring patterns from the center of the platen 408 to the outer edge of the platen 408. Each ring establishes an air delivery zone. Air from an air source can then be directed through the holes during polishing, thus establishing the air bearing. Air is then exhausted past the platen edge.

As shown in FIG. 4A, the active retaining rings 404 and 410 preferably are positioned opposing each other and co-incidental, however, it should be borne in mind that the diameters of the active retaining rings 404 and 410 can differ, as needed by the particular system. As mentioned previously, both active retaining rings 404 and 410 are capable of extending and retracting. The ability to extend and retract allows the active retaining rings 404 and 410 to clamp the polishing belt 412 between them to provide precise positional control of the polishing belt 412. The precise positional polishing belt control provided by the embodiments of the present invention allows controlling of edge effects and standing/harmonic wave effects.

In the retaining ring configuration 400*a* of FIG. 4A, the retaining ring 404 of the wafer head 402 is extended, while the retaining ring 410 of the platen 408 is retracted. Retaining ring configuration 400*a* illustrates how the embodiments of the present invention reduce the removal rate at the edge of the wafer. Extending retaining ring 404 and retracting retaining ring 410 positions the polishing belt 412 away from the edge of the wafer 406, thus reducing the amount of force applied against the wafer edge from the polishing belt 412. The reduced force at the edge of the wafer 406 consequently reduces the removal rate at the wafer edge. To provide additional engineering of the pad shape and interaction with the wafer, the embodiments of the present invention also allow increased removal rates at the wafer edge, as shown next with reference to FIG. 4B.

Figure 4B:
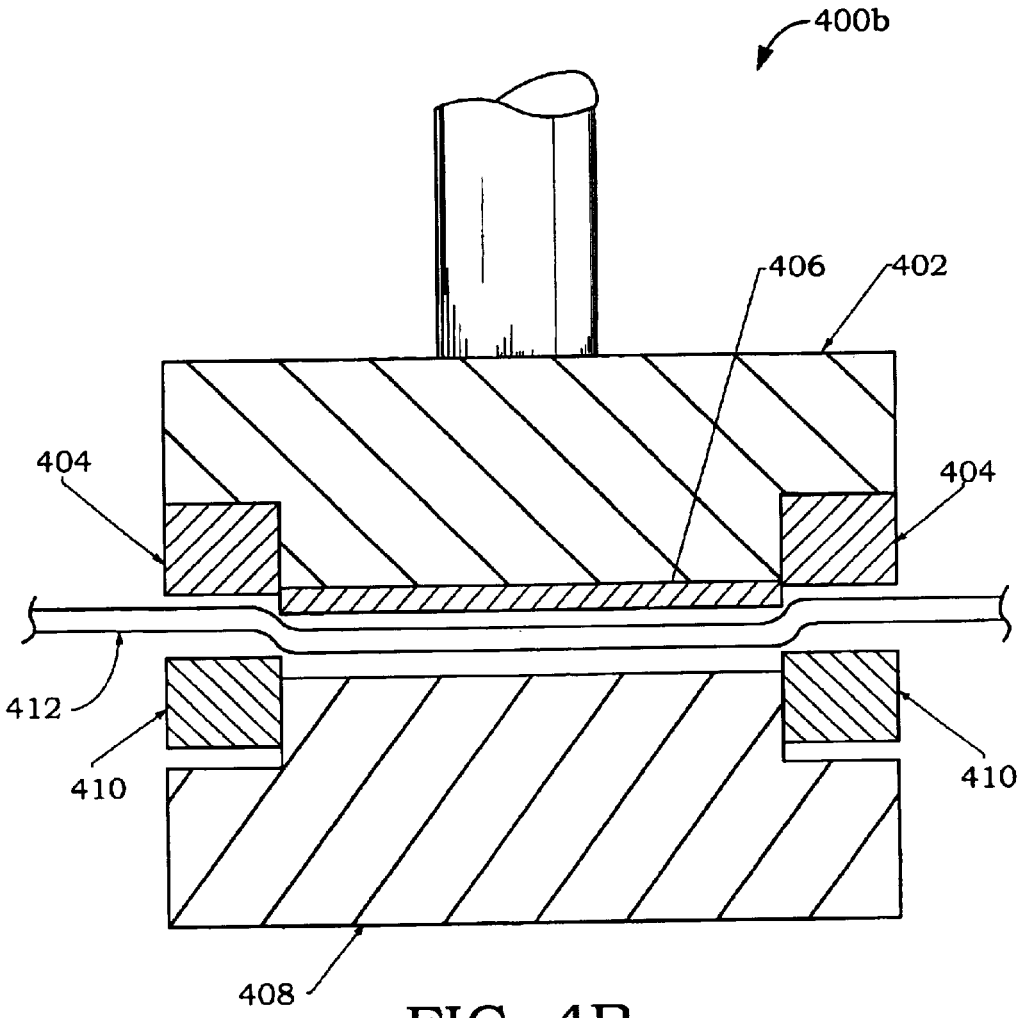
FIG. 4B is a retaining ring configuration for increasing the removal rate at the edge of a wafer, in accordance with an embodiment of the present invention.

FIG. 4B is a retaining ring configuration 400*b* for increasing the removal rate at the edge of a wafer, in accordance with an embodiment of the present invention. The retaining ring configuration 400*b* includes wafer head 402 having active retaining ring 404 and wafer 406 positioned below the wafer head 402. The platen 408 is disposed below the polishing belt 412, and includes active retaining ring 410.

In the retaining ring configuration 400*b* of FIG. 4B, the retaining ring 404 of the wafer head 402 is retracted, while the retaining ring 410 of the platen 408 is extended. Retaining ring configuration 400*b* illustrates how the embodiments of the present invention increase the removal rate at the edge of the wafer. Retracting retaining ring 404 and extending retaining ring 410 positions the polishing belt 412 closer to the edge of the wafer 406, thus increasing the amount of force applied against the wafer edge from the polishing belt 412. The increased force at the edge of the wafer 406 consequently increases the removal rate at the wafer edge. By adjusting the extension and retraction of the retaining rings 404 and 410 as shown in FIGS. 4A and 4B, the removal rate at the wafer edge can be controlled allowing improved edge performance during the CMP process.

Figure 5:
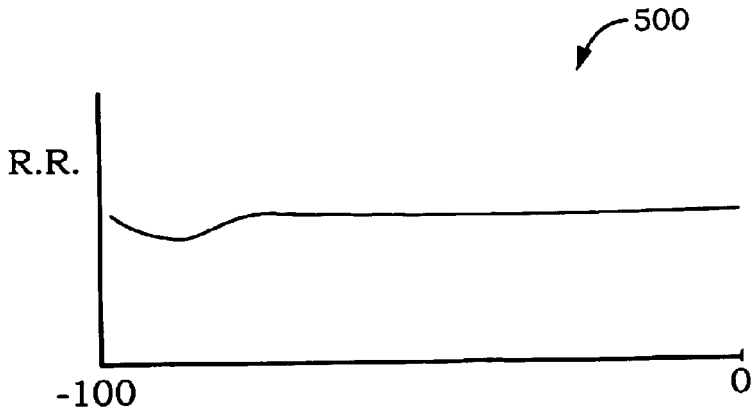
FIG. 5 is a graph showing the CMP removal rate as a function of wafer position during a CMP operation using the active retaining rings, in accordance with an embodiment of the present invention.

FIG. 5 is a graph 500 showing the CMP removal rate as a function of wafer position during a CMP operation using the active retaining rings, in accordance with an embodiment of the present invention. As shown in the graph 500, the removal rate at the edge of the wafer can be made more uniform relative to the removal rate at other positions along the wafer surface. This is a result of controlling the edge removal rate via the retaining rings. As a result, the wafer edges are more uniform and the risk of lowK copper peel at the wafer edge is reduced, as described below.

Figure 6:
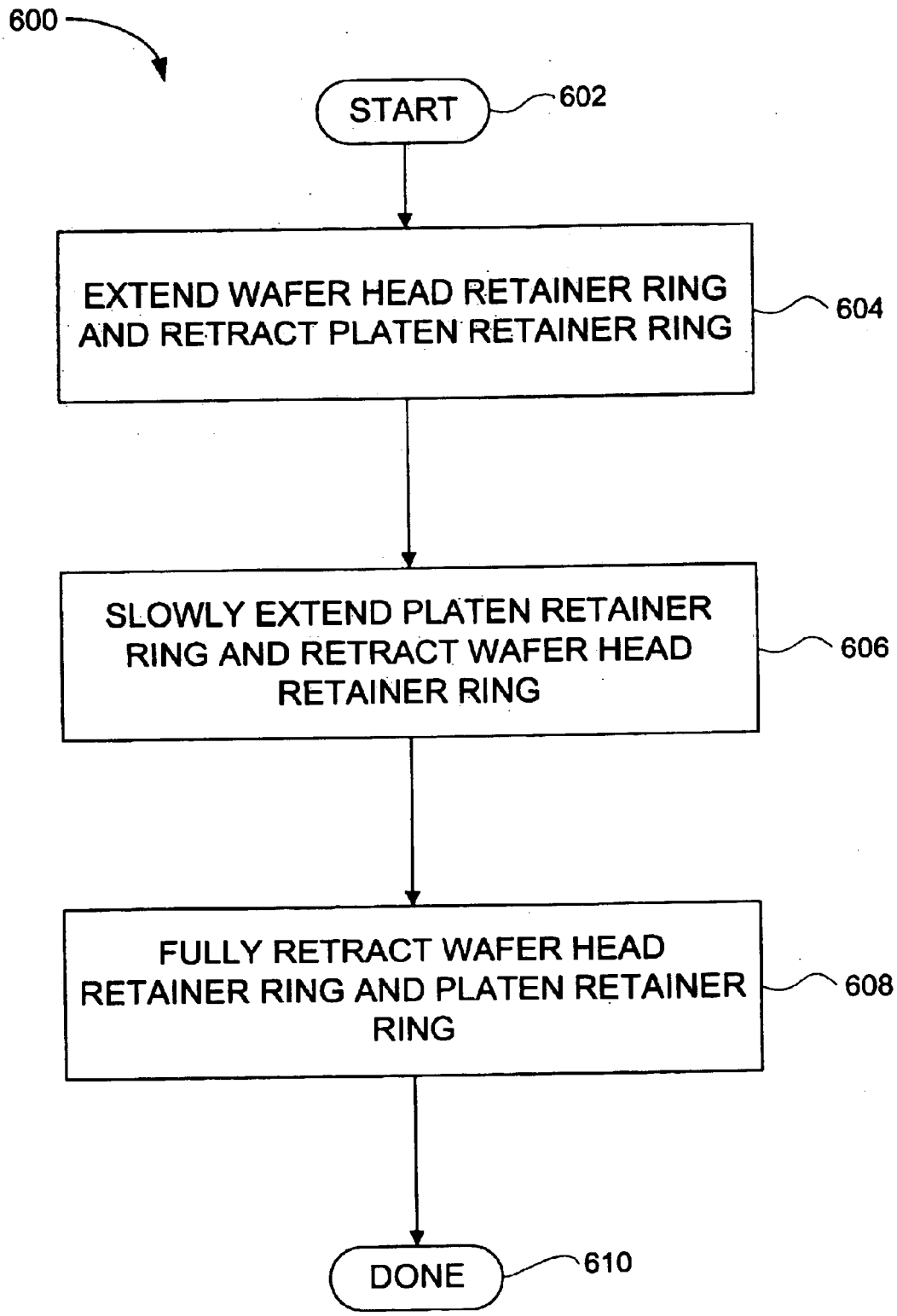
FIG. 6 is a flowchart showing a method for improving edge performance during a CMP process, in accordance with an embodiment of the present invention.

FIG. 6 is a flowchart showing a method 600 for improving edge performance during a CMP process, in accordance with an embodiment of the present invention. Preprocess operations are performed in a preprocess operation 602. Preprocess operations include cleaning the wafer in a cleaning station and other preprocess operations that will be apparent to those skilled in the art.

In a removal rate reduction operation 604, the wafer head retaining ring is extended and the platen retaining ring is retracted. Operation 604 is used to reduce the removal rate at the edge of the wafer. As previously mentioned, extending the wafer head retaining ring and retracting the platen retaining ring positions the polishing belt 412 away from the edge of the wafer 406, thus reducing the amount of force applied against the wafer edge from the polishing belt. The reduced force at the edge of the wafer consequently reduces the removal rate at the wafer edge. In addition, the reduced removal rate at the wafer edge protects low K copper peel at the edge of the wafer from peeling.

Next, in operation 606, the platen retaining ring is slowly extended, while the wafer head retaining ring is slowly retracted. Operation 606 increases the removal rate at the edge of the wafer. Retracting the wafer head retaining ring and extending the platen retaining ring positions the polishing belt closer to the edge of the wafer, thus increasing the amount of force applied against the wafer edge from the polishing belt. The increased force at the edge of the wafer consequently increases the removal rate at the wafer edge. In operation 606 the wafer edge is increasingly revealed to the polishing belt, resulting in a slow ramp of the edge removal rate. This begins the copper removal at the edge of the wafer with reduced risk of peeling the copper.

In operation 608 the wafer head retaining ring 404 and the platen retaining ring 410 are both retracted. Retracting both retaining rings provides a low defect finishing to the wafer, as can be found using "fixed ring" CMP processes. It should be noted that although fixed ring polishing provides low defect generation, the process control advantages provided by the active retaining rings of the present invention provide more desirable wafers. Thus, the embodiments of the present invention preferably use both an active retaining ring technique, as discussed in operations 604 and 606, and a fixed ring technique, as discussed in operation 608.

Post process operations are performed in operation 610. Post process operations include completing the CMP process and other post process operations that will be apparent to those skilled in the art. Advantageously, having the active retaining ring on the platen provides precise positional control allowing the reference height of the active retaining ring on the wafer head to be set. This allows precise engineering of both the pad shape and the pad interaction with the wafer. In addition, the lower retaining ring can be fixed in position by shimming the lower retaining ring to the correct height, thus allowing the lower retaining ring to be an active or passive positional control.

Figure 7:
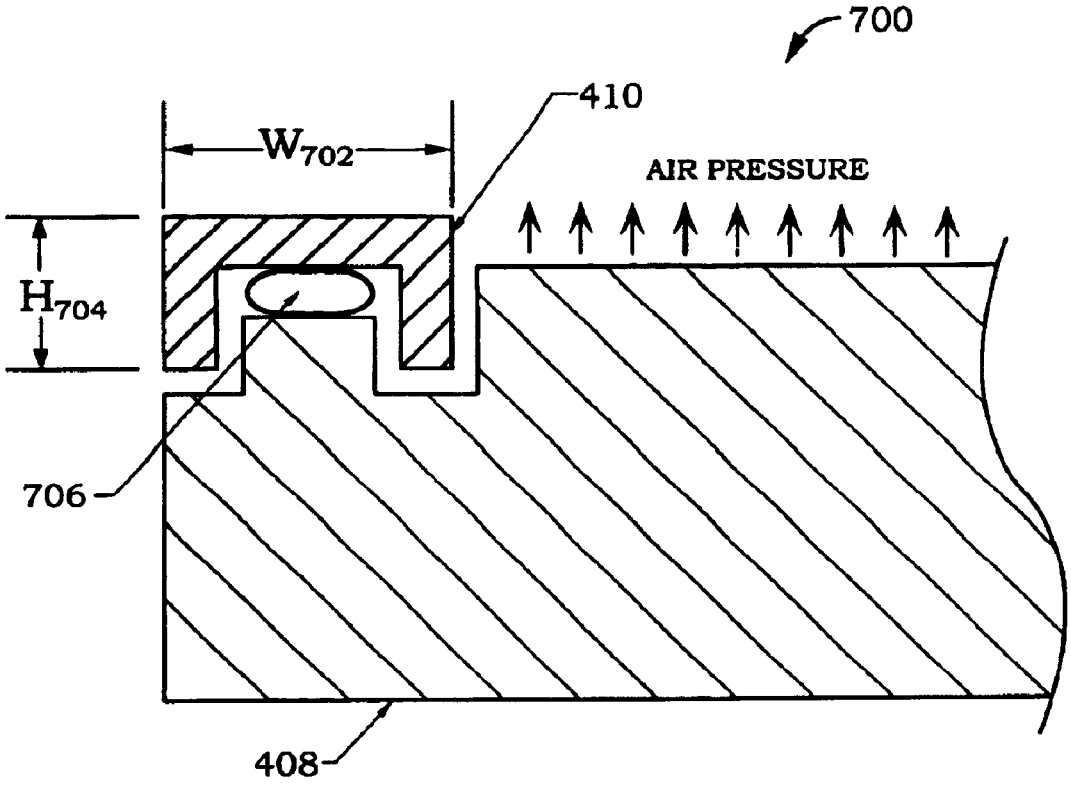
FIG. 7 is a diagram showing a detailed active retaining ring configuration using a bladder, in accordance with an embodiment of the present invention.

FIG. 7 is a diagram showing a detailed active retaining ring configuration 700, in accordance with an embodiment of the present invention. The active retaining ring configuration 700 includes a platen 408 and an active retaining ring 410 disposed above the platen 408. Disposed between the active retaining ring 410 and the platen 408 is an inflatable bladder 706. Preferably, the retaining ring 410 should have a width $W_{702}$ and height $H_{704}$, which allow the retaining ring 410 to operate properly with the retaining ring on the wafer head to provide positional control for the polishing belt.

In one embodiment the $W_{702}$ ranges between about 0.5 inches and about 2 inches, and most preferably about 1.0 inch. In addition, the height $H_{704}$ ranges between about 0.5 inches and about 1 inch, and most preferably about 0.8 inches.

Figure 7A:
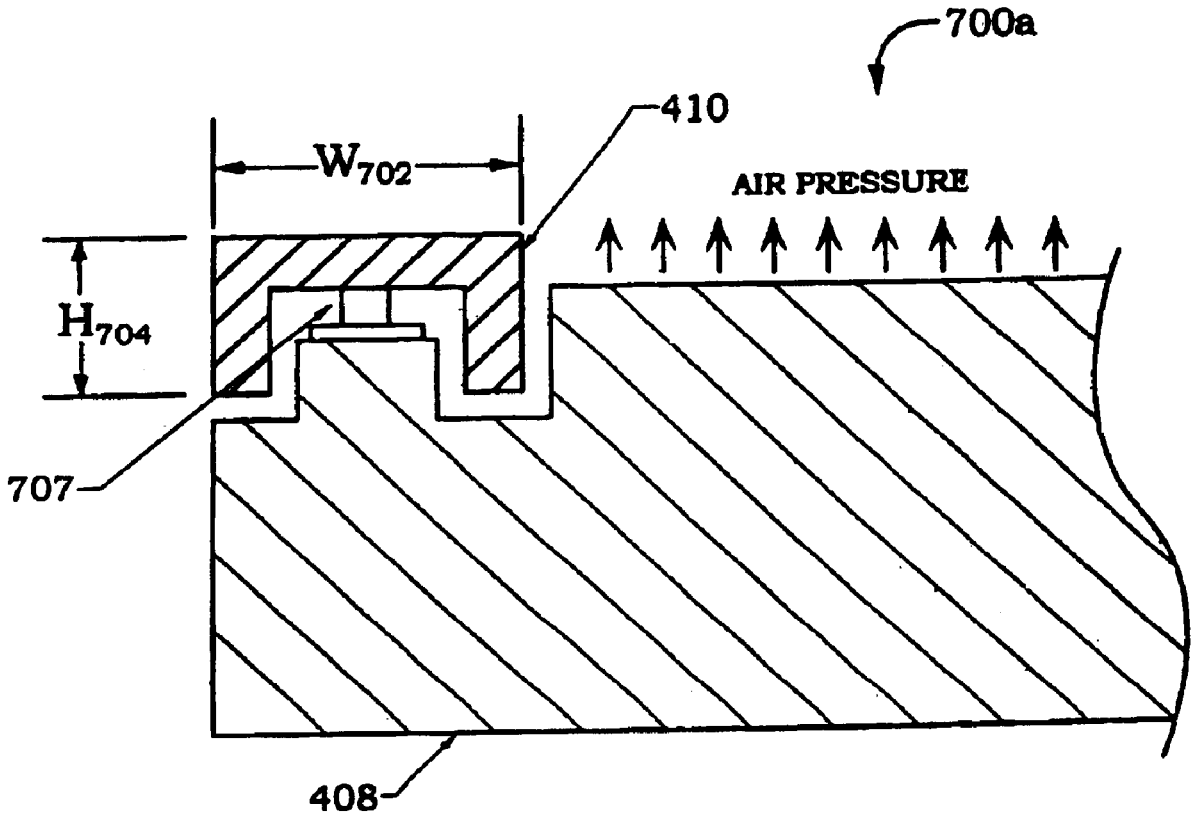
FIG. 7A is a diagram showing a detailed active retaining ring configuration utilizing a piezoelectric motor in accordance with an embodiment of the present invention.

The inflatable bladder 706 is used to apply pressure to the retaining ring 410 to push the retaining ring 410 upward, thus extending the retaining ring 410. In a similar manner, the inflatable bladder 706 can be deflated allowing the retaining ring 410 to fall downward, thus retracting the retaining ring 410. In an alternative embodiment illustrated in FIG. 7A, the inflatable bladder 706 can be replaced by a piezoelectric motor 707 to provide upward and downward pressure to the retaining ring 410, thus allowing extension and retraction of the retaining ring. Although not shown, an inflatable bladder 706 or piezoelectric motor 707 can also be used to provide extension and retraction to the retaining ring 404 of the wafer head as well.

Figure 8:
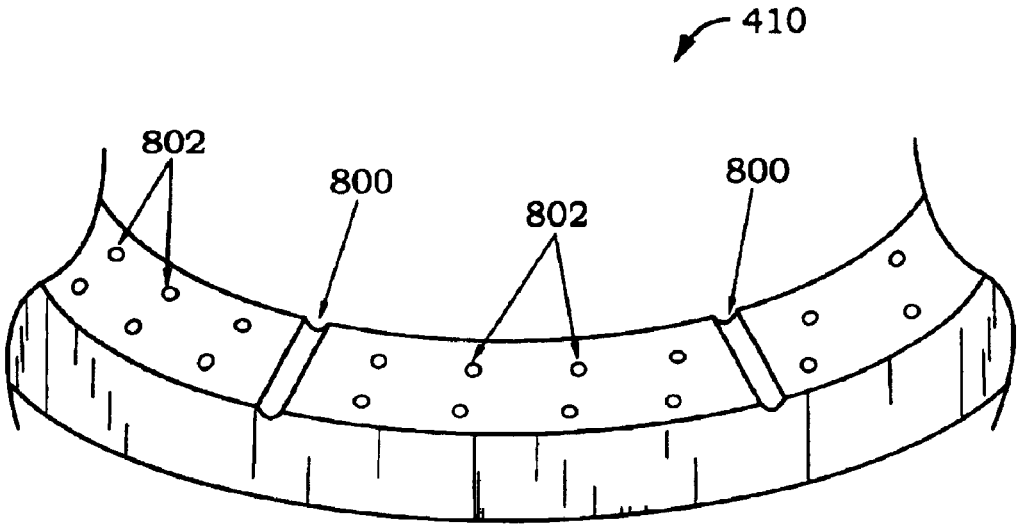
FIG. 8 is a perspective view of the retaining ring of the platen, in accordance with an embodiment of the present invention.

FIG. 8 is a perspective view of the retaining ring 410 of the platen, in accordance with an embodiment of the present invention. As previously mentioned, the retaining ring 410 of the embodiments of the present invention often is used in conjunction with a platen 408 that uses an air bearing to support the polishing pad during a CMP process. When used in this manner, one embodiment of the present invention uses air slots 800 positioned across a width of the active retaining ring 410. The air slots 800 allow the air to pass across the retaining ring 410 so that the air bearing can be maintained at a proper level. The platen retaining ring can have more than one method of activation, such as using a bladder, manual shimming or adjusting, and the retaining ring can also have a guiding mechanism to control the deflection moment of the retaining ring.

In a further embodiment, air holes 802 are provided on top of the retaining ring 410. The air holes 802 effectively extend the air bearing generated by the platen 408 over the width of the retaining ring 410. This allows for increased flexibility in the CMP process and reduces wear on the retaining ring 410 from the polishing pad. Flexibility is increased by allowing varying air pressures along the circumference of the retaining ring 410 to allow for precise force application along the wafer edge. To provide addition protection from wear to the platen 408 and retaining ring 410, a sacrificial material can be positioned between the platen and the polishing belt. The sacrificial material is preferably fed roll to roll over the platen 408, as described in related U.S. patent application Ser. No. 09/747,844, entitled "PIEZOELECTRIC PLATEN DESIGN FOR IMPROVING PERFORMANCE IN CMP APPLICATIONS," the entire disclosure of which is incorporated herein by reference in its entirety.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for improving edge performance in chemical mechanical polishing applications, comprising the operations of:

providing a wafer head having a first active retaining ring, wherein a wafer having an edge is positioned below the wafer head;

providing a platen having a second active retaining ring; and reducing a removal rate at the edge of the wafer by extending the first active retaining ring and retracting the second active retaining ring.

2. A method as recited in claim 1, further comprising the operation of extending the second active retaining ring and retracting the first active retaining ring.

3. A method as recited in claim 2, further comprising the operation of retracting both the first active retaining ring and the second active retaining ring.

4. A method as recited in claim 1, wherein the second active retaining ring is retracted via a bladder disposed between the second active retaining ring and the platen.

5. A method as recited in claim 1, wherein the second active retaining ring is retracted via a piezoelectric motor positioned between the second active retaining ring and the platen.

6. A method as recited in claim 1, wherein the second active retaining ring includes holes allowing air passage, wherein a cushion of air is maintained between a polishing belt and the second active retaining ring during a chemical mechanical polishing process.

7. A method as recited in claim 6, further comprising the operation of providing sacrificial material between the platen and the polishing belt, wherein the sacrificial material reduces wear on the platen and the second active retaining ring.

8. A method as recited in claim 1, wherein the second active retaining ring includes slots positioned across a width of the second active retaining ring, wherein the slots are capable of allowing the passage of air across the second active retaining ring.

9. A method for improving edge performance in chemical mechanical polishing applications, comprising the operations of:

providing a wafer head having a first active retaining ring, the wafer head positioning a wafer below the wafer head;

providing a platen having a second active retaining ring;

extending the first active retaining ring and retracting the second active retaining ring; and extending the second active retaining ring and retracting the first active retaining ring.

10. A method as recited in claim 9, further comprising the operation of retracting both the first active retaining ring and the second active retaining ring.

11. A method as recited in claim 9, wherein the second active retaining ring is extended and retracted via a bladder disposed between the second active retaining ring and the platen.

12. A method as recited in claim 9, wherein the second active retaining ring is extended and retracted via a piezoelectric motor positioned between the second active retaining ring and the platen.

13. A method as recited in claim 9, wherein the second active retaining ring includes holes allowing air passage, wherein a cushion of air is maintained between a polishing belt and the second active retaining ring during a chemical mechanical polishing process.

14. A method as recited in claim 13, further comprising the operation of providing sacrificial material between the platen and the polishing belt, wherein the sacrificial material reduces wear on the platen and the second active retaining ring.

15. A method as recited in claim 9, wherein the second active retaining ring includes slots positioned across a width of the second active retaining ring, wherein the slots are capable of allowing the passage of air across the second active retaining ring.

16. A method for improving edge performance in chemical mechanical polishing applications, comprising the operations of:

providing a wafer head having a first active retaining ring, wherein a wafer having an edge is positioned below the wafer head;

providing a platen having a second active retaining ring, wherein the second active retaining ring includes slots positioned across a width of the second active retaining ring, wherein the slots are capable of allowing the passage of air across the second active retaining ring;

reducing a removal rate at the edge of the wafer by extending the first active retaining ring and retracting the second active retaining ring;

increasing the removal rate at the edge of the wafer by extending the second active retaining ring and retracting the first active retaining ring; and retracting both the first active retaining ring and the second active retaining ring.

17. A method as recited in claim 16, wherein the second active retaining ring is extended and retracted via a bladder disposed between the second active retaining ring and the platen.

18. A method as recited in claim 16, wherein the second active retaining ring is extended and retracted via a piezoelectric motor positioned between the second active retaining ring and the platen.

* * * * *